United States Patent [19]

Miram

[11] 4,263,528

[45] Apr. 21, 1981

[54] GRID COATING FOR THERMIONIC ELECTRON EMISSION SUPPRESSION

[75] Inventor: George Miram, Atherton, Calif.

[73] Assignee: Varian Associates, Inc., Palo Alto, Calif.

[21] Appl. No.: 902,529

[22] Filed: May 3, 1978

[51] Int. Cl.[3] ..... H01J 1/46; H01J 21/10

[52] U.S. Cl. ..... 313/293; 313/107; 313/348; 313/444; 313/448

[58] Field of Search ..... 313/348, 444, 107, 293, 313/447, 448

[56] References Cited

U.S. PATENT DOCUMENTS

| | | | |
|---|---|---|---|
| 2,516,841 | 8/1950 | Arditi et al. | 313/107 |
| 2,821,496 | 1/1958 | Perl | 313/107 X |
| 3,154,711 | 10/1964 | Beggs | 313/348 X |
| 3,196,043 | 7/1965 | Harris et al. | 313/348 X |
| 3,297,902 | 1/1967 | Beggs | 313/348 |
| 3,389,285 | 6/1968 | Thomson | 313/107 |
| 3,504,213 | 3/1970 | Hix et al. | 313/107 X |
| 3,580,739 | 5/1971 | Hofmann et al. | 313/107 |
| 3,638,062 | 1/1972 | Beggs | 313/348 |
| 3,648,096 | 3/1972 | Beggs | 313/348 |
| 3,818,260 | 6/1974 | Elfe, Jr. et al. | 313/348 |

*Primary Examiner*—Saxfield Chatmon, Jr.
*Attorney, Agent, or Firm*—Stanley Z. Cole; Peter J. Sgarbossa; Keiichi Nishimura

[57] ABSTRACT

In an electron gun having a control grid in contact with the face of the cathode, unwanted thermionic emission from the cathode can be effectively suppressed by applying a thin (1 micron) coating of boron nitride to the surface of the control grid. The boron nitride has low thermionic emission itself and, in addition, has an unusual ability to shed or eliminate any deposits of emissive material such as barium or its oxides which come in contact with the boron nitride layer. For optimum performance and longest lifetime, the boron nitride layer is applied over a pyrolytic graphite layer which may be the conductive grid itself.

21 Claims, 5 Drawing Figures

FIG.1
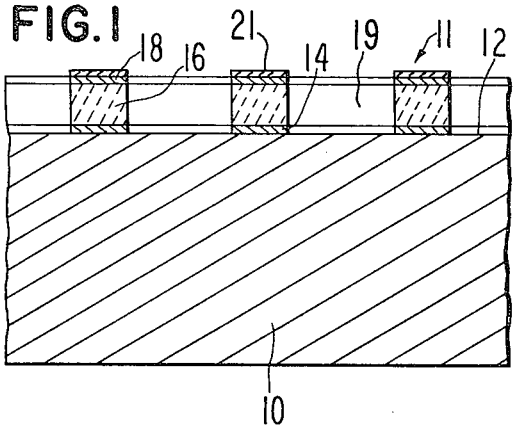
FIG.2a
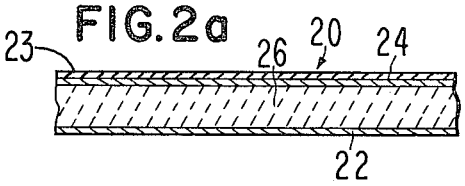
FIG.2b
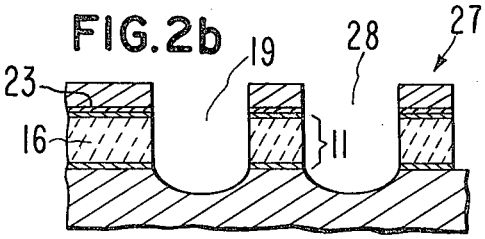
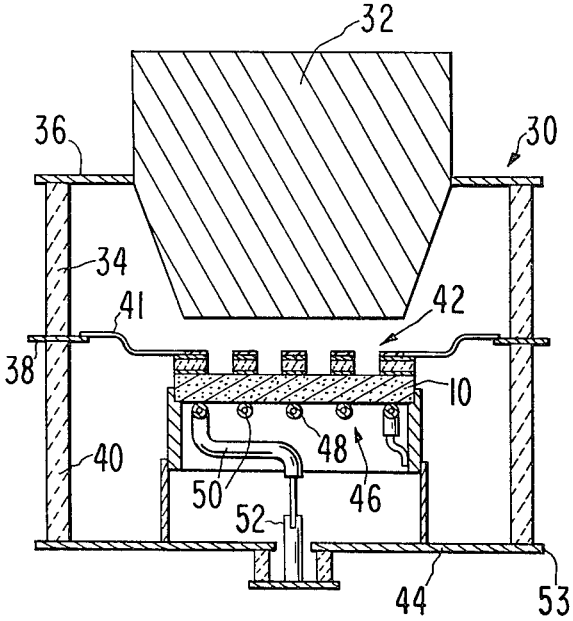
FIG.3
FIG.4
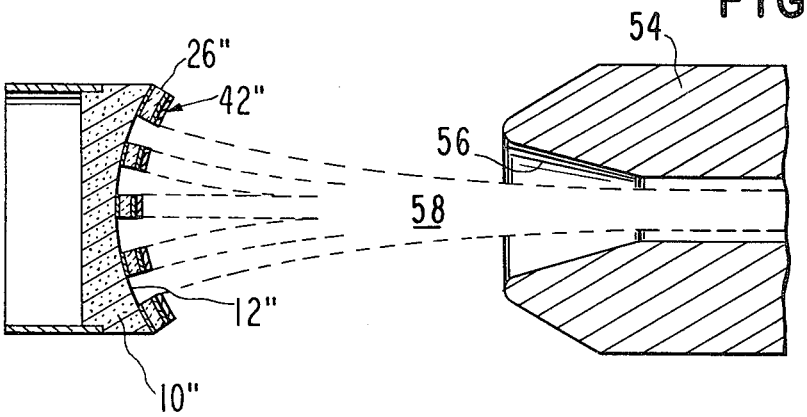

GRID COATING FOR THERMIONIC ELECTRON EMISSION SUPPRESSION

BACKGROUND OF THE INVENTION

Government Contract — This invention was reduced to practice under U.S. Army Electronics Command Contract No. DAAB07-76-C-1379.

FIELD OF THE INVENTION

The invention pretains generally to the suppression of unwanted thermionic electron emission and in particular to the suppression of such emission from the control grid of a gridded thermionic electron source. The invention is especially applicable in those cases where the control grid is actually supported on an insulative member in contact with the emissive surface of the cathode because grid temperature is very nearly as high as cathode temperature under these conditions.

Such grid-controlled electron sources are used in high frequency tubes such as planar triodes and in the electron guns for beam-type microwave tubes. The control grid in a high frequency triode must be very close to the surface of the cathode, so that electron transit time between cathode and grid is minimized.

In other grid-controlled sources, such as the guns for linear-beam microwave tubes and the cathodes of grid-controlled power tubes, a fine-mesh control grid located very close to the cathode surface is employed to maximize transconductance and amplification factor. In some of these tubes the problem of unwanted electron emission from the grid is increased still further by (1) the use of the bonded grid construction wherein the conductive grid is actually mounted on the face of the cathode spaced only by a thin insulative layer, and by (2) the use of dispenser-type cathodes.

The use of the bonded grid construction virtually ensures that the grid will operate at very nearly cathode temperature rather than at a reduced temperature, which is possible when the grid is spaced from the cathode surface.

Dispenser-type cathodes produce a vapor of the emissive material (typically barium or its oxides) which may deposit on nearby surfaces of the tube. While this unwanted deposit is not particularly harmful so long as these surfaces are significantly cooler than the cathode, as they approach cathode temperature they can cause significant, uncontrolled thermionic emission of electrons.

Bonded grids are especially vulnerable to unwanted thermionic emission problems in the presence of a dispenser cathode because of their extreme proximity to the cathode and because they typically operate at a temperature very nearly that of the cathode.

DESCRIPTION OF THE PRIOR ART

My earlier patent application with Erling L. Lien entitled "Thermionic Electron Source with Bonded Control Grid", U.S. Ser. No. 684,689 filed May 10, 1976, detailed a bonded grid cathode in which the control grid is supported on the emissive surface of the cathode by means of a relatively thin insulating layer which is bonded between the actual control grid and the cathode emissive surface. In this earlier electron source, sufficient inhibition of thermionic emission from the control grid was achieved by manufacturing it from an emission inhibiting material such as titanium or zirconium. However, in many applications the degree of thermionic-electron-emission inhibition provided by such means simply is not adequate. In particular, it is noted that the emmission levels increase with continuing usage of the tubes such that after many hours of use the emission levels may be many times those encountered at the start of operation.

SUMMRY OF THE INVENTION

An object of the invention is to provide a means for inhibiting thermionic electron emission from heated electrodes.

A further object of the invention is to provide a grid-controlled electron source in which thermionic emission from the control grid is substantially inhibited.

The above objects are achieved by coating the surfaces from which thermionic emission is to be inhibited with a thin layer of boron nitride. In particular the surface of a grid to be so inhibited may be coated with a thin layer of boron nitride. In a preferred embodiment, an emission-inhibited control grid comprises a wafer of insulative material such as boron nitride coated with a layer of pyrolytic graphite which serves as the conductive control grid, and a thin layer of boron nitride overlaying the pyrolytic graphite, the grid assembly being apertured and either bonded to or clamped against the emissive surface of the cathode.

BRIEF DESCRIPTION OF THE DRAWINGS

FIG. 1 shows a section of an electron source according to the invention;

FIGS. 2A and 2B illustrate the steps in fabricating the source of FIG. 1;

FIG. 3 illustrates a planar triode embodiment of the invention;

FIG. 4 illustrates a convergent beam gun embodying the invention for use in a linear beam microwave tube.

DESCRIPTION OF THE PREFERRED EMBODIMENTS

FIG. 1 illustrates the structure of a small portion of an electron source according to the invention. A thermionic cathode 10, such as a porous tungsten matrix impregnated with molten barium aluminate is heated by a coil of tungsten heater wire insulated by a layer of aluminum oxide (as best shown in FIG. 3). The emissive surface 12 of cathode 10 is shaped to face an anode operating at a suitable positive potential for drawing electron current from the cathode.

Grid web members 11 may have an underlying barrier layer 14 which is attached directly to the emissive surface of the cathode, as by mechanical clamps or by thermal diffusion under pressure. Barrier layer 14 is of a material which will not poison cathode 10 and will prevent chemical interaction between cathode 10 and other materials of the grid web 11. Layer 14 may be a metal which will bond to cathode 10 by thermal diffusion in the presence of heat and pressure, or it may be a layer of a stable form of carbon such as pyrolytic graphite.

Bonded to underlying layer 14 is a layer 16 of insulating material, for example, boron nitride. On the top side of insulating layer 16 is bonded a conductive layer 18 which may be metallic but which in a preferred embodiment is a stable form of carbon, preferably pyrolytic graphite. Layer 18 is insulated from the cathode by layer 16 and serves as the control grid electrode.

Web members 11 are preferably connected as a network having openings 19 through which electron current is drawn from cathode 10. Around the periphery of the web structure, as best seen in FIG. 3. is a wider ring of the laminate whose conductive layer 18 forms an electrically conductive connector for supplying bias to the control grid.

In the preferred form, as noted above, layer 18 comprises pyrolytic graphite, a relatively mechanically stable form of carbon having good thermal and electrical conductivity. Since the formation of a relatively high quality layer of pyrolytic graphite on the surface of boron nitride insulator is a fairly specialized technology, I have found that the best quality and most highly adherent coatings are secured by submitting the boron nitride wafers to businesses which specialize in producing the desired coating of pyrolytic graphite. I have been able to obtain the requisite quality in coatings made by Union Carbide Corporation in Cleveland, Ohio, and by the Super-Temp Company of 11120 South Norwalk Boulevard, Santa Fe Springs, California 90670.

In accordance with the present invention, an additional layer 21 of boron nitride is formed over the surface of conductive layer 18 to suppress thermionic emission from layer 18. Layer 21 must be made sufficiently thin that adequate electrical conductivity (through leakage) is provided to prevent the surface of layer 21 from behaving as a pure insulator which could develop a surface-charge-induced potential different from that of conductive layer 18. I have found that good results in this regard can be obtained by making layer 21 of a thickness of approximately 1 micron or less. Barrier layer 14 may be 1–50 microns thick, insulating layer 16 may be 50 microns thick, and control electrode layer 18 may be 25 microns thick. Web members 11 may be 20 microns in width. Openings 19 between web members 11 may advantageously be shaped as elongated rectangles to allow the greatest proportion of open area while still maintaining grid web members 11 in close proximity to all parts of the emissive area.

FIG. 2*a* shows a section of a laminated sheet 20 formed by depositing pyrolytic graphite or metal layers 22 and 24 on opposite sides of an insulating sheet 26 of boron nitride. Then the top surface of layer 24 is ion sputter etched to clean it, and an approximately one micron layer 23 of boron nitride is deposited.

In FIG. 2*b* a mask 27 having the configuration of the desired grid web structure is placed over the laminated sheet. Mask 27 is of sheet metal with apertures formed by conventional photo-etching techniques. Fine abrasive powders propelled by a jet of high pressure air cut away the portions 19 of laminated sheet 20 through openings 28 in mask 27, leaving web members 11 having the same composite laminated structure as the original sheet 20. Improved accuracy of abrasion has been obtained by cutting from both sides through aligned masks.

FIG. 3 shows a planar triode tube embodying the electron source of the present invention. The tube comprises a vacuum envelope 30 formed partly by metallic anode 32 as of copper sealed to a cylindrical ceramic insulator 34, as of aluminum oxide ceramic, via a metal flange 36 as of iron-cobalt-nickel alloy. A conductive flange 38 as of the above alloy is sealed between ceramic cylinder 34 and a second ceramic cylindrical insulator 40. Flange 38 is connected to grid electrode 42 by spring conductors 41 as of molybdenum or a tantalum-tungsten-columbium alloy which are sufficiently flexible to accommodate to the position of grid 42 which is fixed to cathode 10'. Cathode 10' is mechanically and electrically mounted to a metallic header 44 which is sealed across the bottom end of insulating cylinder 40, completing the vacuum envelope and permitting high-frequency electrical current contacts to all of the electrodes.

Cathode 10' is heated by a radiant heater 46 formed by a coil of tungsten wire 48 insulated by a coating of aluminum oxide 50. An insulated lead-through 52, sealed as by brazing to metallic header 44, conducts heating current.

In operation, resonant cavity radio-frequency circuits, such as coaxial resonators, are connected between cathode flange 53 and grid flange 38 and between grid flange 38 and anode flange 36. These resonators (not shown) contain series bypass capacitors to allow the application of a positive voltage to anode 32 and a bias dc voltage between cathode 10' and grid 42. RF drive energy is applied between cathode 10' and grid 42, modulating the electron flow from cathode 10' to anode 32.

With the exceedingly small cathode-to-grid spacing achievable with the present invention, the transit time of electrons between the cathode and the grid is so small that exceedingly high frequency signals may be amplified. At the same time, the rigid support of the grid electrode with respect to the cathode eliminates modulation by microphonic vibrations and prevents short circuits by deformation of the grid structure.

FIG. 4 illustrates an electron gun according to the present invention adapted to produce a grid-controlled linear electron beam for use in a klystron or travelling wave tube. Cathode 10'' has a concave spherical emissive surface 12'' to converge the electrons into a beam considerably smaller than the area of cathode 10''. Grid 42'' is bonded or attached to cathode 10'' exactly as in the planar triode of FIG. 3. Boron nitride sheet 26'' is formed as a spherical cap, as by chemical-vapor deposition and the composite grid 42'' is then fabricated as described above for a planar grid. Other parts of the gun are similar to those of the triode of FIG. 3 except that the anode 54 is a re-entrant electrode, symetric about the axis of the beam, having a central aperture 56 through which the electron beam 58 passes to be used in the microwave tube.

I have found that the thermionic emission suppression layer of boron nitride according to the present invention when coated over the preferred grid layer 18 consisting of approximately 1 mil of pyrolytic graphite results in extremely effective suppression of thermionic electron emission from the surface of multi-apertured grids even when they are in contact with the face of the cathode. In fact, after more than 1,500 hours of operation in a tube corresponding to that illustrated in FIG. 4 of the present application, no measurable thermionic emission from the grid was present. In experiments using a similar layer of boron nitride over other control grid materials such as the metals tungsten or molybdenum, the initial suppression of thermionic emission from the grid was also excellent although thermionic emission increased with continued operation of the tube.

I attribute this high performance of the boron nitride as a thermionic emission suppression layer to the fact that barium and its compounds which are continuously released from the cathode surface do not seem to stick to boron nitride, at least at the temperatures encountered in normal tube operation. The further enhancement of the performance of boron nitride suppression layers when they are coated over pyrolytic graphite control grid layers is not at present possible to explain.

Since many other embodiments and uses of the invention will be apparent to those skilled in the art, the above examples are only illustrative and not limiting. In particular, boron nitride thermionic emission suppression coatings can be expected to find many uses in electron tubes and other related devices. Accordingly, my invention is intended to be limited only by the following claims and their legal equivalents.

What is claimed is:

1. A grid-controlled electron source comprising, a thermionic cathode having an electron-emissive surface, a multi-apertured insulative layer, and a multi-apertured control grid overlaying said electron emissive surface, said control grid comprising a multi-apertured conductive layer which is electrically isolated from said thermionic cathode by said insulative layer, said insulative layer being bonded to said control grid, the surface of said conductive layer distal said cathode being coated with a layer of boron nitride whereby the flow of thermionic electrons from said thermionic cathode can be controlled by applying a selected potential difference between said cathode and said conductive layer, and thermionic electron emission from said grid is inhibited by said boron nitride layer.

2. The electron source of claim 1, wherein said control grid includes clamp means to bias said control grid against said electron-emissive surface of said cathode.

3. The electron source of claim 1 wherein said multi-apertured conductive layer is a layer of carbon.

4. The electron source of claim 3 wherein said layer is made of pyrolytic graphite.

5. The electron source of claim 1 wherein said boron nitride layer has a thickness of 1 micron or less.

6. The source of claim 1, in which said insulative layer comprises boron nitride.

7. The source of claim 1 wherein said insulative layer comprises a barrier layer attached directly to said electron-emissive surface.

8. The source of claim 7 in which said barrier layer is a metal bonded to said electron-emissive surface.

9. The structure of claim 7 in which said barrier layer is a layer of a stable form of carbon.

10. A grid-controlled electron source comprising:

a cathode capable of emitting thermionic electrons;

a control grid adjacent and insulated from said cathode, having a surface distal said cathode and capable of emitting thermionic electrons; and a layer of boron nitride coating said surface, said layer being sufficiently thin to inhibit the emission of thermionic electrons from said surface, and to not behave as a pure insulator.

11. The electron source of claim 10 in which said layer of boron nitride is of the order of one micron in thickness.

12. The electron source of claim 10 in which said control grid comprises graphite.

13. The electron source of claim 10 in which said control grid comprises tungsten.

14. The electron source of claim 10 in which said control grid comprises molybdenum.

15. The electron source of claim 10 in which said thermionic cathode includes barium.

16. The source of claim 1 in which said insulative layer comprises boron nitride.

17. A thermionic bonded-grid-controlled electron source providing suppression of thermionic emission by said grid, comprising:

a thermionic cathode having an electron-emissive surface;

a multi-apertured conductive grid overlaying said electron emissive surface;

an insulative member interposed between said emissive surface and said conductive member;

a barrier layer interposed between said insulative member and said emissive surface;

and a boron nitride layer coating the surface of said conductive layer distal said cathode, said layer being much less thick than said insulative member to preclude said layer from behaving as a pure insulator, said layer inhibiting thermionic emission by said conductive layer, said cathode, grid, insulative member and barrier layer comprising a bonded unit, whereby thermionic electron emission from said cathode may be controlled by application of a selected potential between said conductive layer and said cathode, minimal cathode-to-grid spacing is provided, while thermionic emission from said grid is inhibited.

18. A source as in claim 17, in which said boron nitride is no more than approximately 1 micron in thickness, while said insulative member is of the order of 50 microns in thickness.

19. A source as in claim 17 in which said insulative member is boron nitride.

20. A source as in claim 17 in which said grid comprises graphite.

21. The electron source of claim 1 wherein said thermionic cathode, conductive layer and insulative layer comprise a bonded unit.

* * * * *